US005716017A

United States Patent [19]

Kemppi et al.

[11] Patent Number: 5,716,017

[45] Date of Patent: Feb. 10, 1998

[54] METHOD AND ARRANGEMENT IN CONNECTION WITH A CONTINUOUSLY OPERATING SPOOLER

[75] Inventors: Kyösti Kemppi; Risto Leskinen, both of Espoo, Finland

[73] Assignee: Nokia-Maillefer Oy, Finland

[21] Appl. No.: 718,503

[22] PCT Filed: Apr. 4, 1995

[86] PCT No.: PCT/FI95/00182

§ 371 Date: Oct. 1, 1996

§ 102(e) Date: Oct. 1, 1996

[87] PCT Pub. No.: WO95/26923

PCT Pub. Date: Oct. 12, 1995

[30] Foreign Application Priority Data

Apr. 5, 1994 [FI] Finland ..... 941549

[51] Int. Cl.[6] ..... B65H 54/00

[52] U.S. Cl. ..... 242/25 A; 242/18 PW; 242/125.1

[58] Field of Search ..... 242/25 A, 125.1, 242/18 PW

[56] References Cited

U.S. PATENT DOCUMENTS

| | | | |
|---|---|---|---|
| 2,546,636 | 3/1951 | Hanson et al. | 242/25 A |
| 2,674,414 | 4/1954 | Hicks et al. | 242/25 A |
| 3,003,714 | 10/1961 | Lloyd et al. | 242/125.1 |
| 3,695,528 | 10/1972 | Taki et al. | 242/25 A |
| 3,761,030 | 9/1973 | Leinonen et al. | 242/25 A |
| 3,814,340 | 6/1974 | Maillefer | 242/25 A |
| 3,913,858 | 10/1975 | Ikegami | 242/25 A |
| 4,015,785 | 4/1977 | Ikegami et al. | 242/25 A |
| 4,044,960 | 8/1977 | Lemaire | 242/25 A |
| 4,369,928 | 1/1983 | Riekkinen et al. | 242/25 A |
| 4,958,778 | 9/1990 | Tanaka | 242/25 A |
| 5,593,101 | 1/1997 | Varga | 242/18 PW |

FOREIGN PATENT DOCUMENTS 876841 9/1961 United Kingdom .

OTHER PUBLICATIONS

Patent Abstracts of Japan, vol. 13, No. 281, M–842, abstract of JP, A, 1–75370 (Sumitomo Electric Ind Ltd), 22 Mar. 1898 (22.03.89).

*Primary Examiner*—William Stryjewski
*Attorney, Agent, or Firm*—Nixon & Vanderhye P.C.

[57] ABSTRACT

A method and arrangement in connection with a continuously operating spooler is provided, in which the thread to be spooled is arranged to be guided onto an empty reel after a first reel has become full by means of a moving finger and a gripper rotating with the empty reel. The thread to be spooled is moved using the finger, into the path of the gripper. The movement of the thread carried out by means of the finger is synchronized with the movement of the gripper in such a manner that the finger manages to move the thread into the path of the gripper before the gripper reaches the meeting point of the gripper and the thread.

8 Claims, 1 Drawing Sheet

METHOD AND ARRANGEMENT IN CONNECTION WITH A CONTINUOUSLY OPERATING SPOOLER

TECHNICAL FIELD

The present invention relates to a method in connection with a continuously operating spooler, in which method the thread to be spooled is guided onto an empty reel after a first reel has become full by means of a moving finger located in the spooler and a gripping means rotating with the empty reel by moving the thread to be spooled, using the moving finger, into the path of the gripping means, the movement of the thread carried out by means of the finger being synchronized with the movement of the gripping means in such a manner that the finger manages to move the thread into the path of the gripping means before the gripping means reaches the meeting point of the gripping means and the thread.

BACKGROUND

Methods and arrangements of this type are currently widely known in different industrial fields. Electric cable industry can be mentioned as an example of industrial fields in which solutions of this type are used.

The basic principle of the previously known solutions has been that after a reel has become full, the thread to be spooled is moved onto the path of the gripping means rotating with an empty reel by a continuous movement of the finger. The disadvantage of this known principle is that the gripping means may collide with the thread before the thread has reached the middle line of the gap of the gripping means, i.e. the path of the gripping means, as pulled by the finger. If the gripping means collides with the thread in the above-mentioned way, the probable result is a breaking of the thread and an unsuccessful change of the spooling side. The breaking of the thread to be spooled thus causes interruptions of production and thus decreases productivity. It should be noted in this connection that the present-day spooling speeds can be very high, wherefore the amount of damaged material created in connection with a breaking of the thread may be extremely great in some cases.

Examples of publications in which the prior art is described, and solutions disclosed are Finnish Published Specification 46,611 (corresponding to U.S. Pat. No. 3,761,030), British Patent 876,841 and U.S. Pat. Nos. 2,546,636, 3,695,528 and 3,814,340.

SUMMARY OF THE INVENTION

The object of this invention is to provide a method and arrangement by means of which the disadvantages of the prior art can be obviated. The method of the invention is characterized in that the synchronized movement of the finger is carried out in two stages in such a manner that the finger is moved into a waiting position, in which the path of the thread is tangential with the path of the gripping means, and a moment depending on the speed of rotation and position of the gripping means is determined for initiating the continuation movement of the finger. As for the arrangement of the invention, it is characterized in that the synchronized movement of the finger is arranged to be carried out in two stages in such a manner that the finger is moved into a waiting position, in which the path of the thread is tangential with the path of the gripping means and in which the finger is arranged to remain until the moment for initiating the continuation movement of the finger, this moment depending on when the speed of rotation and position of the gripping means has been determined.

The principal advantage of the invention is that the breaking of the thread resulting from an uncontrollable collision between the gripping means and the thread can be eliminated effectively. This will result in improving productivity and reducing material loss in comparison with the prior art. A further advantage of the invention is its simplicity, the implementation of the invention being thus advantageous especially when the advantage in productivity achieved with the invention is taken into account.

In the following, the invention will be described in more detail by means of a preferred embodiment shown in the accompanying drawings.

DETAILED DESCRIPTION OF THE DRAWINGS

Figure 1:
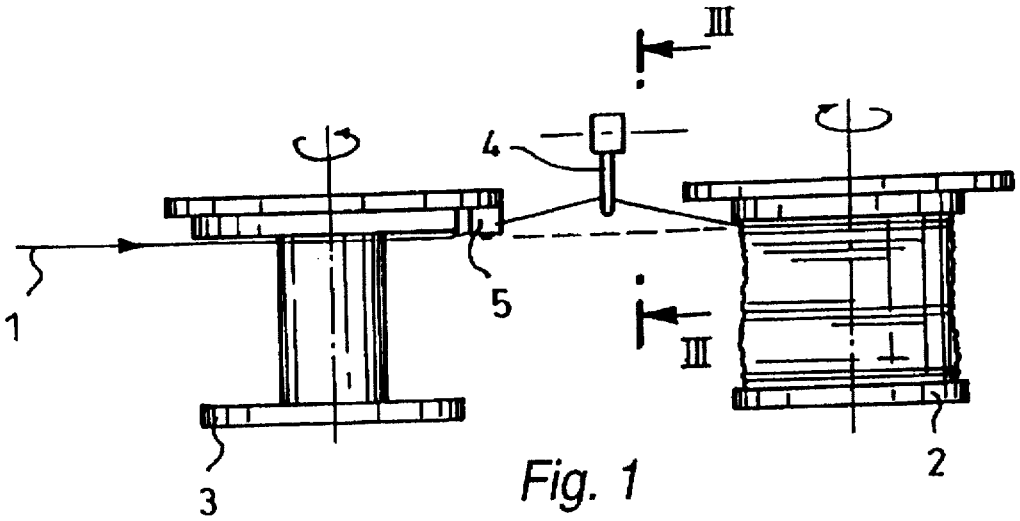
FIG. 1 shows the arrangement of the invention as a schematic top view.

FIG. 1 shows schematically the arrangement of the invention. The thread to be spooled is denoted by reference numeral 1. The reel that has become full in connection with spooling is denoted by reference numeral 2, and the empty reel is denoted by reference numeral 3, correspondingly. The moving finger located in the spooler and the gripping means or gripper rotating with the reel are denoted by reference numerals 4 and 5, respectively.

The reels 2, 3 are rotated by means of the spooler in accordance with the arrows shown in FIG. 1, the thread to be spooled thus spooling itself onto the reels in a manner known as such. For the sake of clarity, only those parts that are essential to the invention are shown in FIG. 1. The general structure and operation of a spooler are fully known to one skilled in the art, wherefore they are not dealt with in more detail in this context. It is only noted in this context that after the reel 2 has become full, the thread to be spooled is moved by means of the moving finger 4 located in the spooler onto the path of the gripping means 5 rotating with the empty reel 3. FIG. 1 shows the path of the thread 1 to be spooled before the deflection carried out by means of the finger 4 by dashed lines. The gripping means 5 is fitted onto a plate which is part of the structures on which the reel is mounted, the gripping means 5 thus rotating with the reel at the same speed as the reel. When the thread to be spooled moves onto the path of the gripping means, the gripping means grips the thread and guides the thread onto the empty reel.

Figure 2:
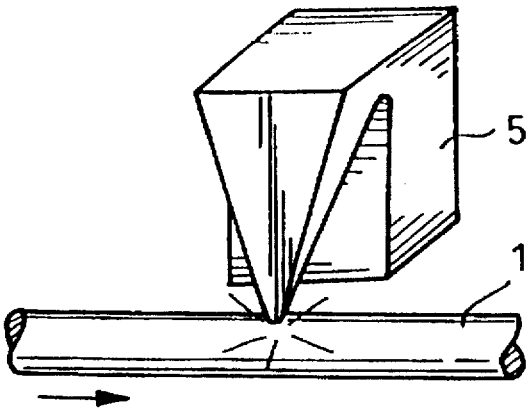
Fig. 2 (Prior Art)
FIG. 2 shows schematically known arrangement a where the gripping means collides uncontrollably with the thread.

In the prior art, problems have appeared in connection with moving the thread, because in the previous solutions, it has been possible that the gripping means collides with the thread before the thread has managed to move into the middle line of the gap of the gripping means as pulled by the finger. FIG. 2 shows schematically a situation where the gripping means 5 collides with the thread 1 in the above-mentioned manner. The probable result of the collision according to FIG. 2 is a breaking of the thread and all the problems that result from it. The object of the invention is to eliminate the situation according to FIG. 2.

According to the essential idea of the invention, the movement of the thread 1 carried out by the finger 4 is synchronized with the movement of the gripping means 5 in such a manner that the finger 4 manages to move the thread 1 onto the path of the gripping means before the gripping means 5 reaches the meeting point of the gripping means and the thread 1. The above-mentioned synchronization can be carried out in various ways. In the example of the figures, the synchronized movement of the thread 1 carried out by means of the finger 4 is carried out in two stages. In moving the thread 1, the finger 4 is first moved from the initial position into a waiting position A, in which the path of the thread is tangential with the path of the gripping means. The waiting position A of the finger 4 is denoted by continuous lines in FIG. 3. The movement stage from the initial position to the waiting position is denoted by arrow LA in FIG. 3. When the finger 4 is in the waiting position A, the moment for initiating the continuation movement of the finger is determined in such a manner that the finger manages to move the thread 1 by means of the above-mentioned continuation movement onto the path of the gripping means before the gripping means 5 reaches the meeting point of the gripping means and the thread 1, this moment depending on the position of the finger 4 and the gripping means 5 in relation to each other. The final position of the continuation movement of the finger 4 is denoted by dashed lines in FIG. 3. The movement stage from the waiting position to the final position denoted by dashed lines, i.e. the continuation movement of the finger, is denoted by arrow LL in FIG. 3.

The above-mentioned two-stage movement of the finger 4 can be produced by stopping the movement of the finger in the initial situation when the finger is in the waiting position A, i.e. in the position where the thread is located slightly away from the path of the gripping means. The finger can be stopped by means of a stopping means 6 in the example of the figures. A situation where the stopping means 6 holds the finger 4 in the waiting position A is denoted by continuous lines in FIG. 3. In this situation, the stopping means 6 is in a protruding position. The stopping means holds the finger in the waiting position A as long as the right moment for initiating the continuation movement of the finger has been determined. The right moment for initiating the continuation movement of the finger can be determined by determining the speed of rotation of the gripping means 5 and the position of the gripping means, it being thus possible to move the thread into the gap of the gripping means without the danger of the thread and the tip of the gripping means colliding as shown in FIG. 2. The continuation movement of the finger can be initiated for instance when the gripping means 5 is located as far as possible from the meeting point of the gripping means 5 and the thread 1, as seen in the direction of rotation.

Figure 3:
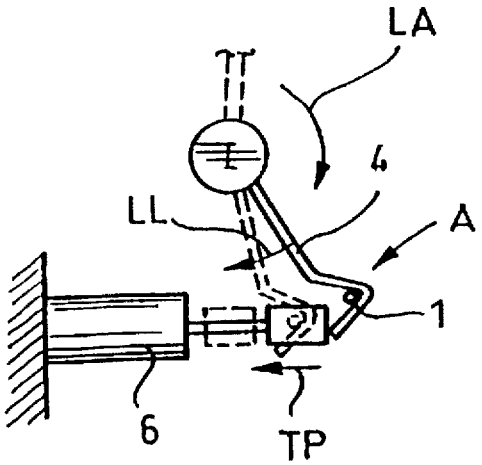
FIG. 3 shows a detail of the arrangement of the invention as a side view according to arrows III—III in FIG. 1.

After the right moment for initiating the continuation movement of the finger has been determined, the stopping means is given a command to retract into a posterior position, which is shown by dashed lines in FIG. 3. The movement of the stopping means 6 into the posterior position is denoted by arrow TP. Due to the retraction of the stopping means, the finger is able to perform its continuation movement and move the thread in such manner that it moves onto the path of the gripping means at the right moment without the danger of the thread breaking.

The movement of the finger can be carried out by any manner known in the field. Any regulating unit that enables a fast movement can be used as the stopping mean. Suitable examples of regulating units include a solenoid and a pneumatic cylinder. The speed of rotation of the gripping means and the position of the gripping means can be determined by means of any known equipment. The necessary calculations can be performed by means of conventional calculating means. Equipments and calculating means of this type are fully known to one skilled in the art, wherefore they are not dealt with in more detail in this context.

The above-mentioned embodiment is by no means intended to restrict the invention but the invention can be modified freely within the scope of the claims. It is thus apparent that it is not necessary for the arrangement of the invention or its details to be exactly like shown in the figures but that other types of solutions are also possible. The thread can be any type of thread: insulated, bare, etc. The material of the thread can be for instance steel, copper, aluminum, etc. The invention can applied to threads of different thicknesses. The diameter of bare threads can be for instance 0.2–6 mm, and the diameter of insulated threads as measured with the insulation for instance as much as 20 mm, etc. The insulation material can be any suitable material, for instance rubber, plastic, paper, etc. The structure of the spooler can also very, and the reels can be brought and removed for instance on the passage principle, etc. Naturally, it is also possible to determine the movement and position of the gripping means partly or entirely before the finger is in the waiting position, etc.

We claim:

1. In a method for guiding a thread onto an empty reel after a first reel in a continuously operating spooler has become full, utilizing a moving finger on the spooler in cooperation with a gripper rotating with the empty reel, the improvement comprising:

synchronizing movement of the finger and the gripper so as to insure movement of the thread into a path of movement of the gripper before the gripper reaches a meeting point between the gripper and the thread by a) engaging the thread with the finger and moving the finger into a waiting position where a path of movement of the thread is tangential with the path of movement of the gripper; and b) depending on rotational speed and location of the gripper, initiating a continuation movement of the finger to move the thread into the path of movement of the gripper so that the gripper engages the thread and guides the thread onto the empty reel.

2. A method according to claim 1 wherein the continuation movement of the finger is initiated when the gripper is located as far as possible from the meeting point of the gripper and the thread, as seen in a direction of rotation of the empty reel.

3. In a continuously operating spooling apparatus wherein a thread to be spooled is guided onto an empty reel after a first reel has become full, utilizing a finger on the spooler to move the thread into a path of movement of a gripper on the empty reel, the improvement comprising means for synchronizing movement of the finger and the gripper to insure that the thread is moved into the path of the gripper before the gripper reaches a meeting point between the thread and the gripper, said means being synchronized to first move the finger and the thread into a waiting position where a path of movement of the thread is tangential with the path of movement of the gripper, and to then initiate a continuation movement of the finger and the thread, depending on rotational speed and location of the gripper, to move the thread into the path of movement of the gripper so that the gripper engages the thread and guides the thread onto the empty reel.

4. Apparatus according to claim 3 wherein the finger is stopped in the waiting position by a retractable stopper.

5. An arrangement according to claim 4, wherein the stopper is a solenoid.

6. An arrangement according to claim 4, wherein the stopper is a pneumatic cylinder.

7. Apparatus according to claim 4 including means for retracting the stopper.

8. Apparatus according to claim 7 wherein said means is arranged to retract the stopper when the gripper is located as far as possible from the meeting point of the gripper and the thread as seen in a direction of rotation of the empty reel.

* * * * *